US007874469B2

(12) United States Patent
Liu

(10) Patent No.: US 7,874,469 B2
(45) Date of Patent: Jan. 25, 2011

(54) NAILING DEPTH ADJUSTABLE DEVICE FOR A NAIL GUN

(75) Inventor: Angi Liu, Tiachung (TW)

(73) Assignee: Basso Industry Corp., Taichung (TW)

( * ) Notice: Subject to any disclaimer, the term of this patent is extended or adjusted under 35 U.S.C. 154(b) by 154 days.

(21) Appl. No.: 12/212,973

(22) Filed: Sep. 18, 2008

(65) Prior Publication Data

US 2010/0065603 A1 Mar. 18, 2010

(51) Int. Cl.
*B25C 1/04* (2006.01)

(52) U.S. Cl. ..... 227/142; 227/8; 227/120; 227/130

(58) Field of Classification Search ..... 227/142, 227/120, 8, 130
See application file for complete search history.

(56) References Cited

U.S. PATENT DOCUMENTS 6,024,267 A * 2/2000 Chen ..... 227/8
6,581,815 B1 * 6/2003 Ho et al. ..... 227/142
7,097,084 B2 * 8/2006 Ho ..... 227/8
7,318,546 B2 * 1/2008 Segura et al. ..... 227/142
7,341,172 B2 * 3/2008 Moore et al. ..... 227/8
7,431,187 B2 * 10/2008 Tachihara et al. ..... 227/142

FOREIGN PATENT DOCUMENTS

TW 441470 6/2001
TW 210509 9/2003

* cited by examiner

*Primary Examiner*—Rinaldi I. Rada
*Assistant Examiner*—Michelle Lopez
(74) *Attorney, Agent, or Firm*—Merchant & Gould P.C.

(57) ABSTRACT

A nailing depth adjustable device for a nail gun includes: a barrel-extending part mounted slidably on a barrel; an interconnecting part extending from the barrel-extending part and defining a driving surface; a support; and a telescopic adjusting unit mounted movably on the support and including a first part and a second part that is coupled movably to the interconnecting part, that defines a driven surface, and that engages threadedly the first part so as to be rotatable relative to the first part and the interconnecting part and therefore to be movable relative to the first part and the interconnecting part, thereby permitting adjustment of the distance between the driving and driven surfaces.

8 Claims, 10 Drawing Sheets

NAILING DEPTH ADJUSTABLE DEVICE FOR A NAIL GUN

BACKGROUND OF THE INVENTION

1. Field of the Invention

The invention relates to a nailing depth adjustable device for a nail gun, more particularly to a nailing depth adjustable device including a telescopic adjusting unit for adjusting a traveling distance of a barrel-extending part.

2. Description of the Related Art

Referring to FIG. 1, Taiwanese Patent Number 210509 discloses a conventional pneumatic nail gun 1 including: a gun housing 11 having a front end; a barrel 12 extending frontwardly from the front end of the gun housing 11 in a nail-discharging direction; a magazine 13 connected to a rear end of the barrel 12 for supplying nails into the rear end of the barrel 12; an actuating mechanism mounted in a lower part of the gun housing 11 and including an actuating member (not shown) movable between enable and disable states for enabling and disabling discharging of the nails through the barrel 12, and a trigger 14 for triggering discharging of the nails when the actuating member is disposed at the enabling state; a barrel-extending part 15 mounted slidably on the barrel 12 so as to be slidable on the barrel 12 in the nail-discharging direction and having a front open end 151 adapted for abutting against an object (not shown) to be nailed and for serving as a nail-discharging outlet; a driving part 16 supported movably on the gun housing 11, extending toward the actuating member, and having a driving end 161 for driving movement of the actuating member and a supporting end opposite to the driving end 161; and a telescopic adjusting unit disposed at an upper side of the barrel 12 and including an operating screw nut 17 mounted rotatably on the supporting end of the driving part 16, and a screw rod 18 secured to the barrel-extending part 15 and engaging threadedly the operating screw nut 17.

Rotation of the operating screw nut 17 relative to the screw rod 18 results in movement of the barrel-extending part 15 in the nail-discharging direction, thereby permitting adjustment of the distance (L) between the front open end 151 of the barrel-extending part 15 and the driving end 161 of the driving part 16 in the nail-discharging direction.

In use, the front open end 151 of the barrel-extending part 15 is pressed against the object to be nailed such that the barrel-extending part 15, the telescopic adjusting unit and the driving part 16 are co-moved rearwardly relative to the gun housing 11 in the nail-discharging direction by a fixed distance so as to drive the actuating member from the disabling state to the enabling state. The trigger 14 is subsequently pushed to trigger discharging of the nails. Since the moving distance of the barrel-extending part 15 relative to the gun housing 11 is fixed during a nailing operation, the longer the distance (L) between the front open end 151 of the barrel-extending part 15 and the driving end 161 of the driving part 16, the shallower will be the depth for the nail to penetrate into the object.

Referring to FIG. 2, Taiwanese patent publication number 441470 discloses another conventional pneumatic nail gun 6 including: a gun housing 61; a barrel 62 extending from the gun housing 61; a barrel-extending part 63 mounted slidably on the barrel 62; a driving part 64 for moving an actuating member (not shown) to move from a disabling state to an enabling state; and a telescopic adjusting unit 65 coupled to the barrel-extending part 63 and the driving part 64. The conventional pneumatic nail gun 6 has a structure differing from that of the aforesaid conventional pneumatic nail gun 1 mainly in that the telescopic adjusting unit 65 is disposed at a lower side of the gun housing 61.

Each of the aforesaid conventional pneumatic nail guns 1, 6 requires movement of the respective barrel-extending part 15, 63 relative to the barrel 12, 62 in the nail-discharging direction to a desired position so as to adjust the distance (L) between the front open end 151 of the barrel-extending part 15, 63 and the driving end 161 of the driving part 16, 64 and therefore to adjust the desired nailing depth.

SUMMARY OF THE INVENTION

The object of the present invention is to provide a nailing depth adjustable device for a nail gun that permits adjustment of the desired nailing depth by moving one of two parts of a telescopic adjusting unit relative to the other of the two parts and an interconnecting part that extends from the barrel-extending part so as to adjust a distance between a driving surface of the interconnecting part and a driven surface of said one of the two parts.

According to the present invention, there is provided a nailing depth adjustable device for a nail gun. The nail gun includes a gun housing having a front end, a barrel extending frontwardly from the front end of the gun housing in a nail-discharging direction and having a front open end, a magazine connected to a rear end of the barrel for supplying nails into the barrel, and an actuating member movable between enable and disable states for enabling and disabling discharging of the nails. The nailing depth adjustable device comprises: a barrel-extending part adapted to be mounted slidably on the barrel so as to be slidable on the barrel in the nail-discharging direction, and having a front open end adapted to be disposed frontwardly of the front open end of the barrel for abutting against an object to be nailed and for serving as a discharging outlet of the nails; an interconnecting part extending from the barrel-extending part so as to be co-movable with the barrel-extending part in the nail-discharging direction, and defining a driving surface; a support adapted to be secured to the gun housing; and a telescopic adjusting unit mounted movably on the support and including a spring-loaded first part that is movable relative to the support in the nail-discharging direction between an initial position and an actuating position for moving the actuating member from the disable state to the enable state, and a second part that is coupled movably to the interconnecting part, that defines a driven surface facing and aligned with the driving surface in the nail-discharging direction, and that engages threadedly the first part so as to be rotatable relative to the first part and the interconnecting part and therefore to be movable relative to the first part and the interconnecting part in the nail-discharging direction, thereby permitting adjustment of the distance between the driving and driven surfaces. The barrel-extending part and the interconnecting part are co-movable rearwardly relative to the first and second parts and the support in the nail-discharging direction from a starting position to a driving position, in which the driving and driven surfaces contact each other, when the driving and driven surfaces are spaced apart from each other, and are further co-movable rearwardly relative to the support in the nail-discharging direction from the driving position to a final position so as to drive the first part through the second part to co-move with the barrel-extending part and the interconnecting part from the initial position to the actuating position, thereby permitting adjustment of a traveling distance of the barrel-extending part from the starting position to the final position through adjustment of the distance between the driving and driven surfaces.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
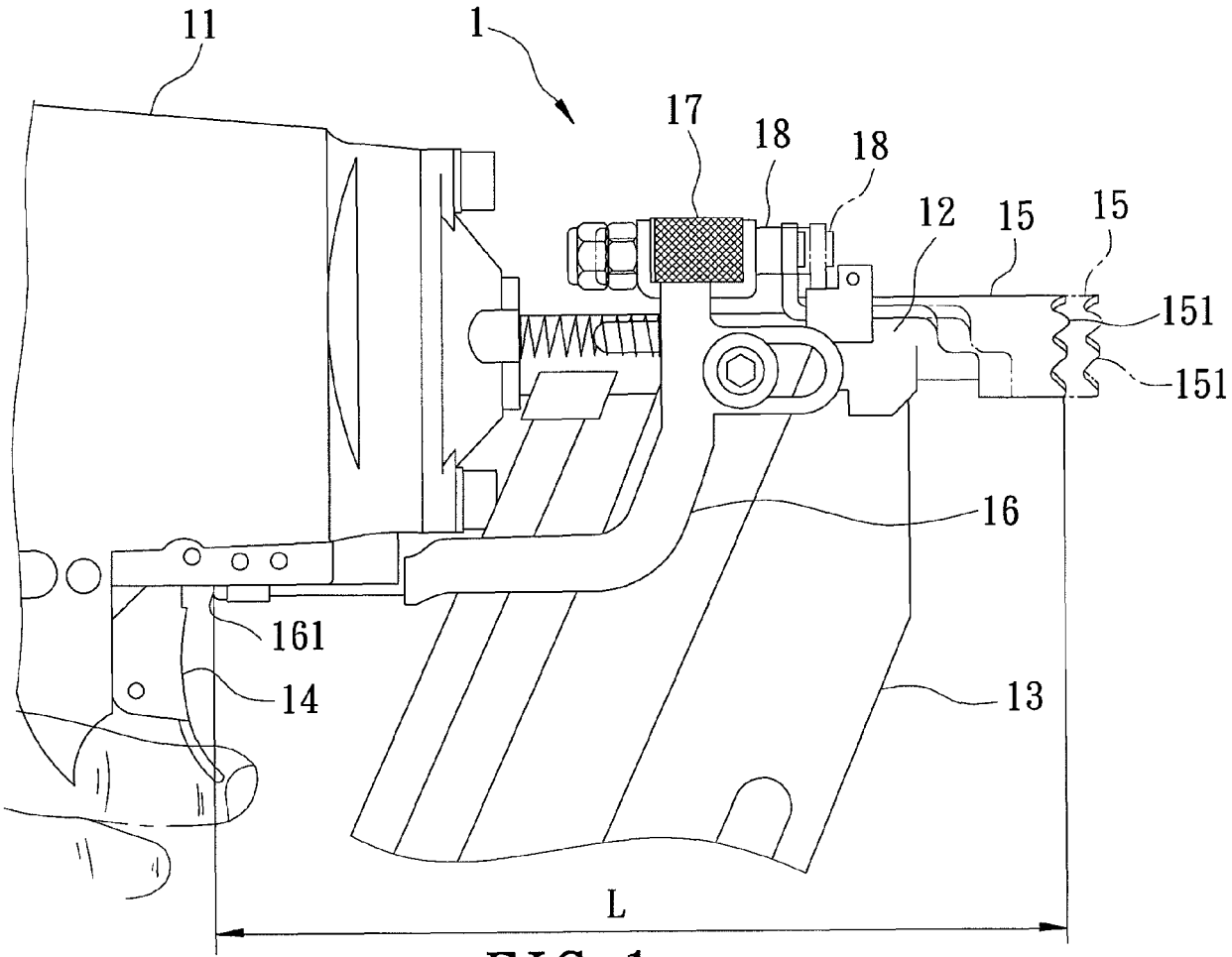
FIG. 1 PRIOR ART
FIG. 1 is a fragmentary schematic view of a conventional nail gun.
Figure 2:
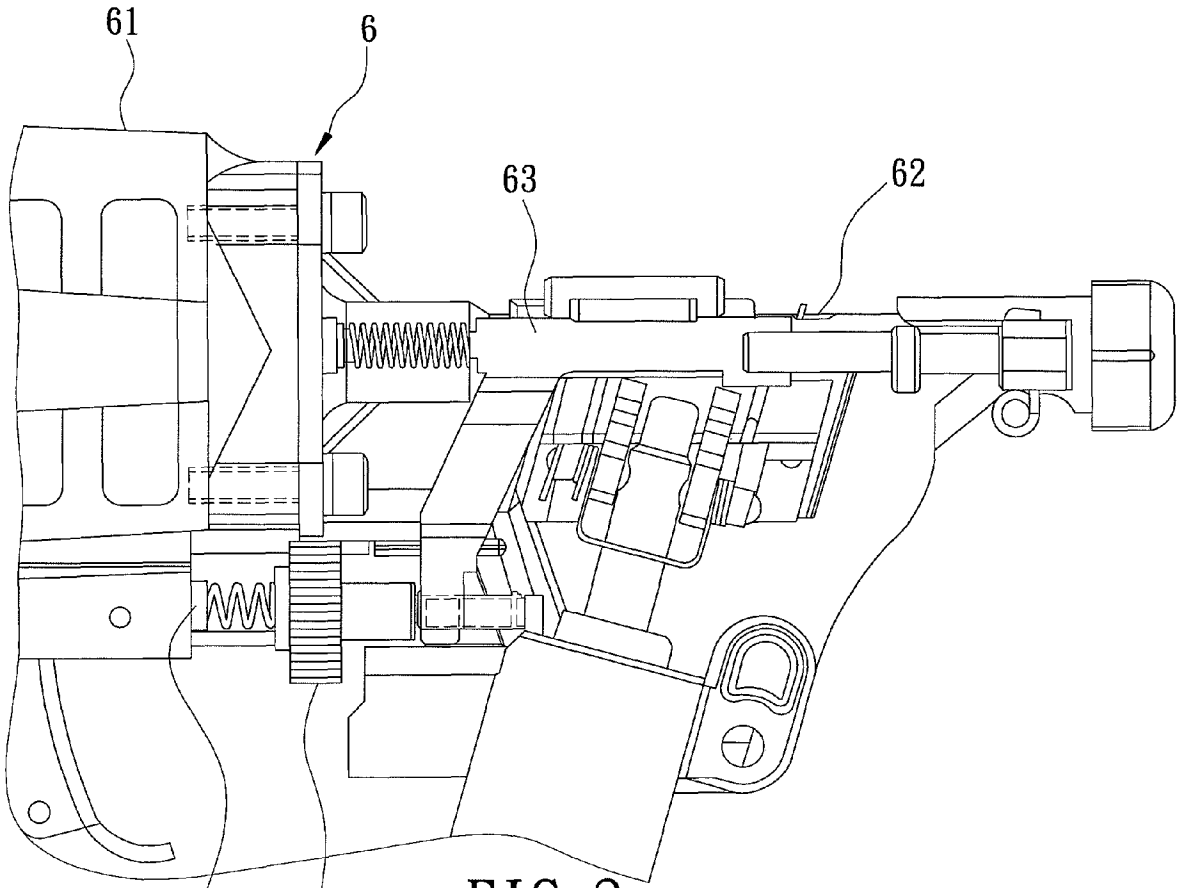
FIG. 2 PRIOR ART
FIG. 2 is a fragmentary schematic view of another conventional nail gun.

Before the present invention is described in greater detail with reference to the accompanying preferred embodiments, it should be noted herein that like elements are denoted by the same reference numerals throughout the disclosure.

Figure 3:
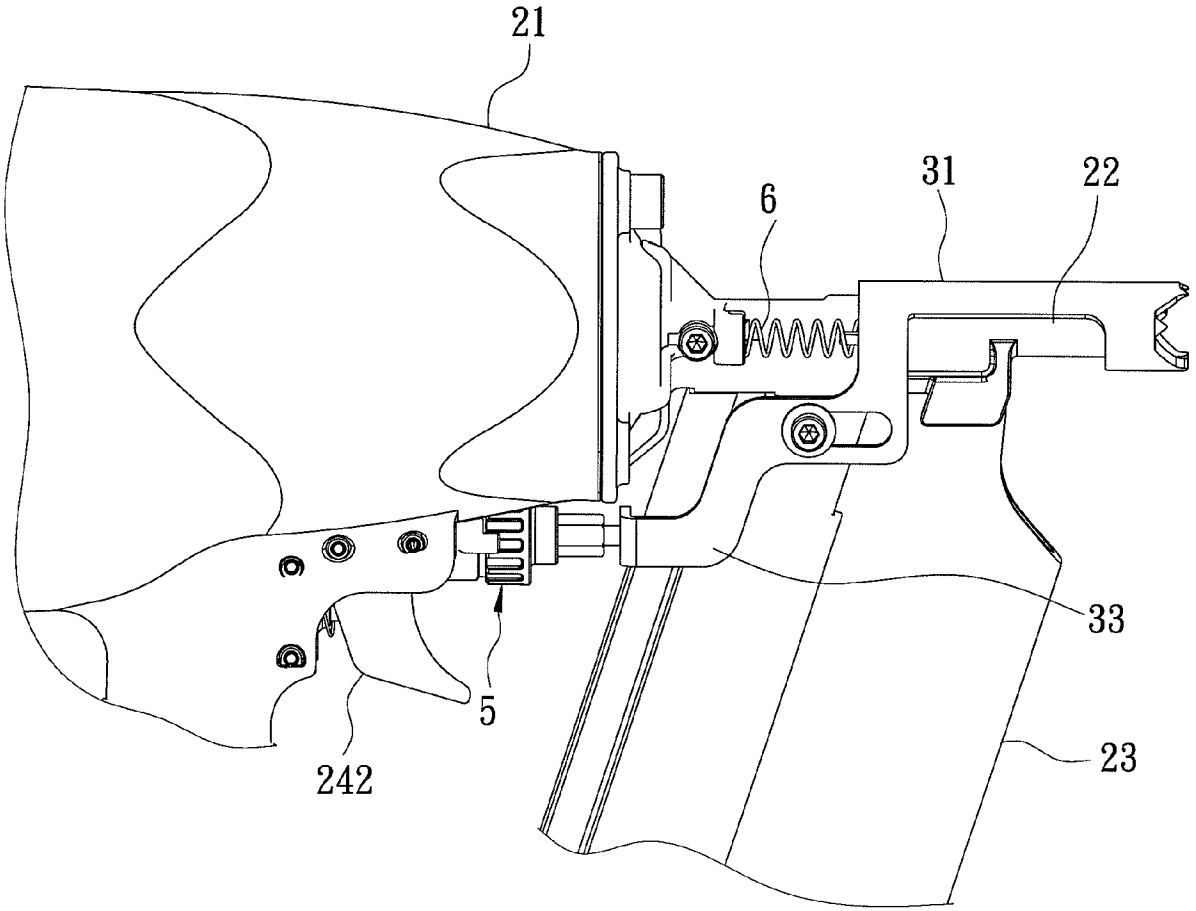
FIG. 3 is a fragmentary schematic view of the first preferred embodiment of a nailing depth adjustable device for a nail gun according to the present invention.
Figure 6:
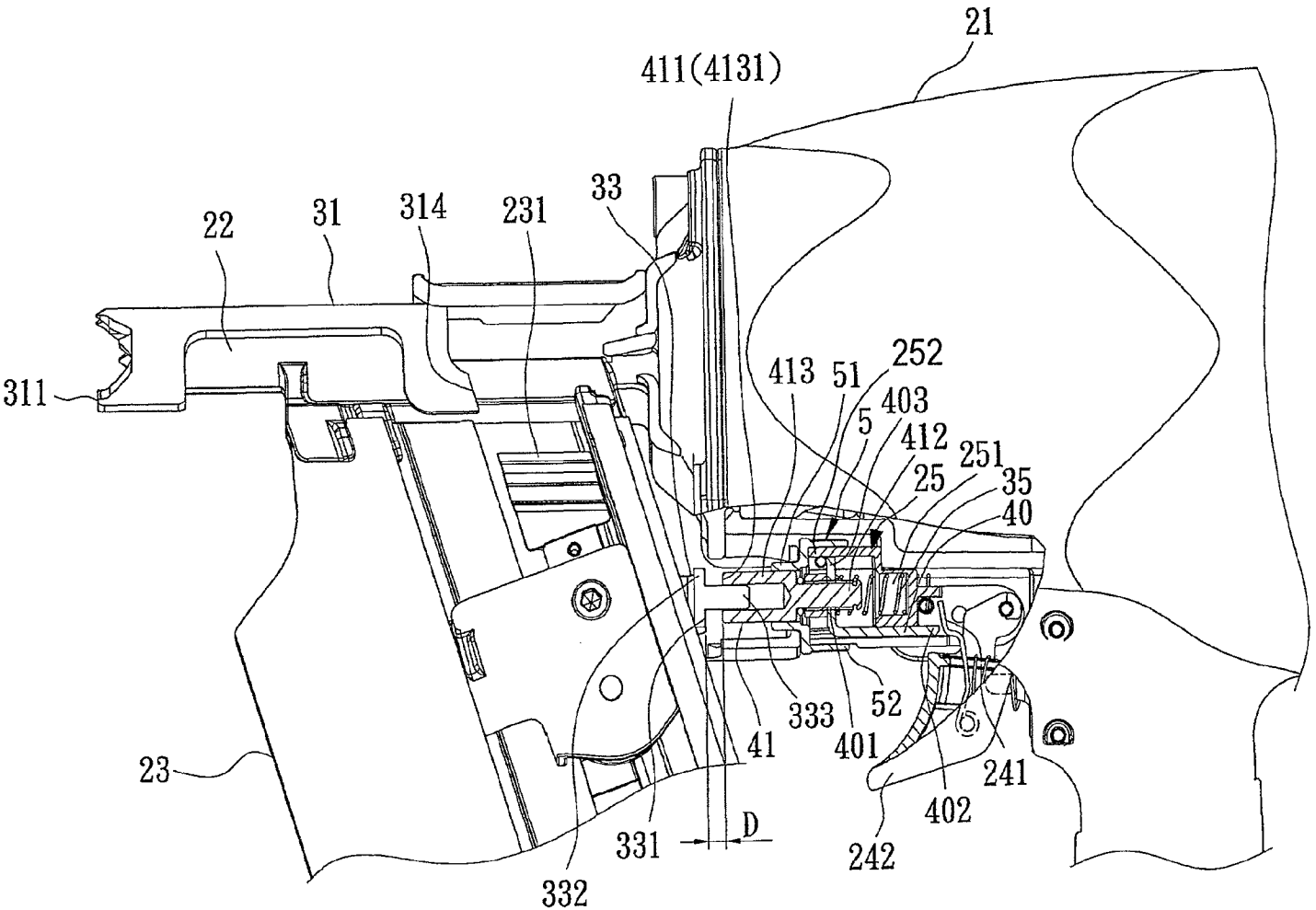
FIG. 6 is a fragmentary partly sectional view of the first preferred embodiment, illustrating a state where the distance between the driving and driven surfaces is not adjusted to zero and where the actuating member is disposed at a disabling state.
Figure 7:
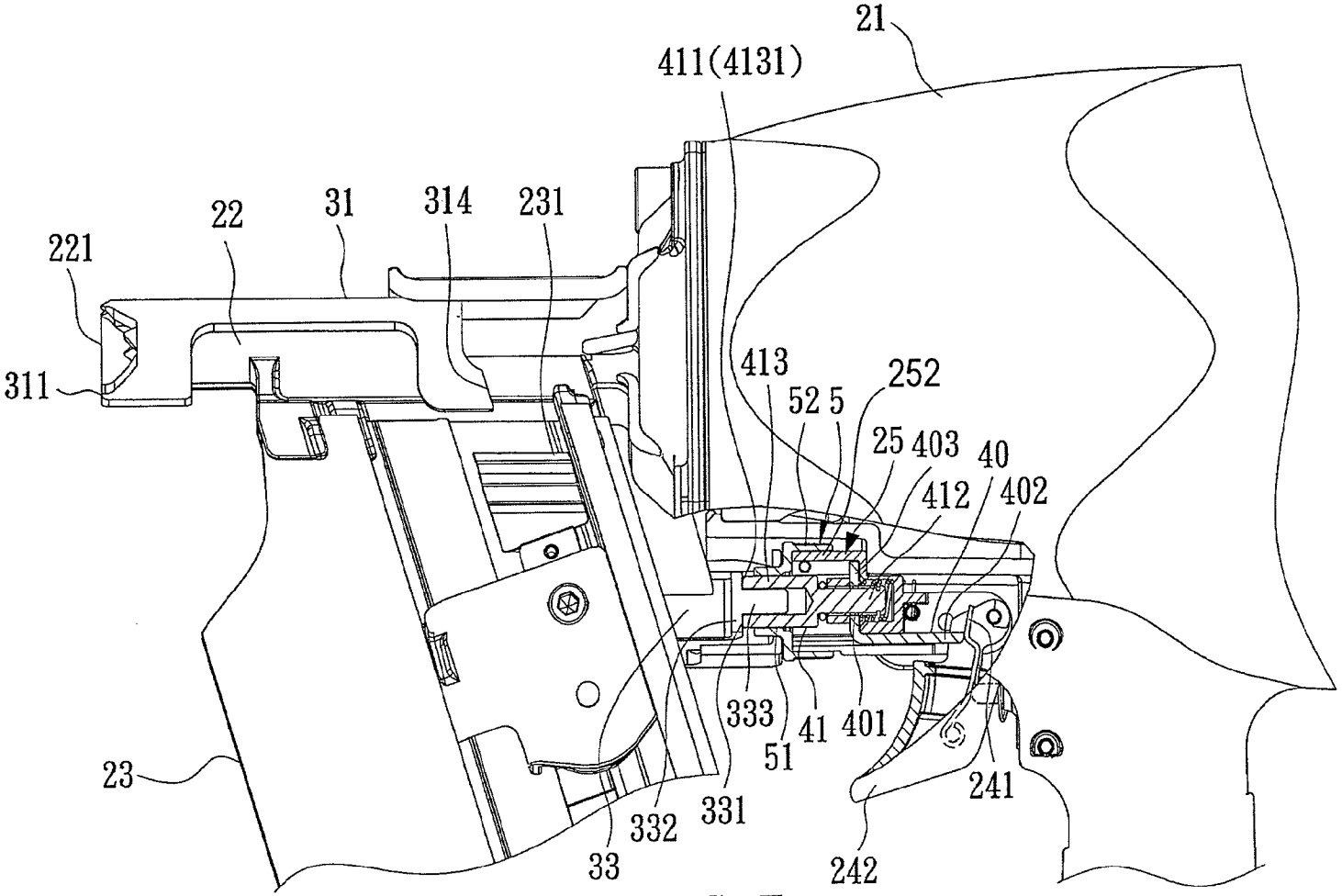
FIG. 7 is a fragmentary partly sectional view of the first preferred embodiment, illustrating a state where the distance between the driving and driven surfaces is not adjusted to zero and where the actuating member is disposed at an enabling state.

FIGS. 3, 6 and 7 illustrate the first preferred embodiment of a nailing depth adjustable device for a nail gun according to the present invention. The nail gun includes a gun housing 21 having a front end, a barrel 22 extending frontwardly from the front end of the gun housing 21 in a nail-discharging direction and having a front open end 221 (see FIG. 7), a magazine 23 connected to a rear end of the barrel 22 for supplying nails (not shown) into the barrel 22, an actuating member 241 movable between enable and disable states (see FIGS. 6 and 7) for enabling and disabling discharging of the nails, and a trigger 242 for triggering discharging of the nails through the barrel 22 when the actuating member 241 is disposed at the enabling state.

The nailing depth adjustable device includes: a barrel-extending part 31 adapted to be mounted slidably on the barrel 22 so as to be slidable on the barrel 22 in the nail-discharging direction, and having a front open end 311 adapted to be disposed frontwardly of the front open end 221 of the barrel 22 for abutting against an object (not shown) to be nailed and for serving as a discharging outlet of the nails; an interconnecting part 33 extending from the barrel-extending part 31 so as to be co-movable with the barrel-extending part 31 in the nail-discharging direction, and defining a driving surface 331; a support 25 adapted to be secured to a lower side of the gun housing 21; and a telescopic adjusting unit mounted movably on the support 25 and including a spring-loaded first part 40 that is movable relative to the support 25 in the nail-discharging direction between an initial position (see FIG. 6) and an actuating position (see FIG. 7) for moving the actuating member 241 from the disable state to the enable state, and a second part 41 that is coupled movably to the interconnecting part 33, that defines a driven surface 411 facing and aligned with the driving surface 331 in the nail-discharging direction, and that engages threadedly the first part 40 so as to be rotatable relative to the first part 40 and the interconnecting part 33 and therefore to be movable relative to the first part 40 and the interconnecting part 33 in the nail-discharging direction, thereby permitting adjustment of the distance (D) between the driving and driven surfaces 331, 411 (see FIG. 6). The barrel-extending part 31 and the interconnecting part 33 are co-movable rearwardly relative to the first and second parts 40, 41 and the support 25 in the nail-discharging direction from a starting position (see FIG. 6) to a driving position (not shown), in which the driving and driven surfaces 331, 411 contact each other, when the driving and driven surfaces 331, 411 are spaced apart from each other, i.e., when the distance (D) between the driving and driven surfaces 331, 411 is greater than zero, and are further co-movable rearwardly relative to the support 25 in the nail-discharging direction from the driving position to a final position (see FIG. 7) so as to drive the first part 40 through the second part 41 to co-move with the barrel-extending part 31 and the interconnecting part 33 from the initial position (see FIG. 6) to the actuating position (see FIG. 7), thereby permitting adjustment of a traveling distance of the barrel-extending part 31 from the starting position to the final position through adjustment of the distance (D) between the driving and driven surfaces 331, 411.

Figure 4:
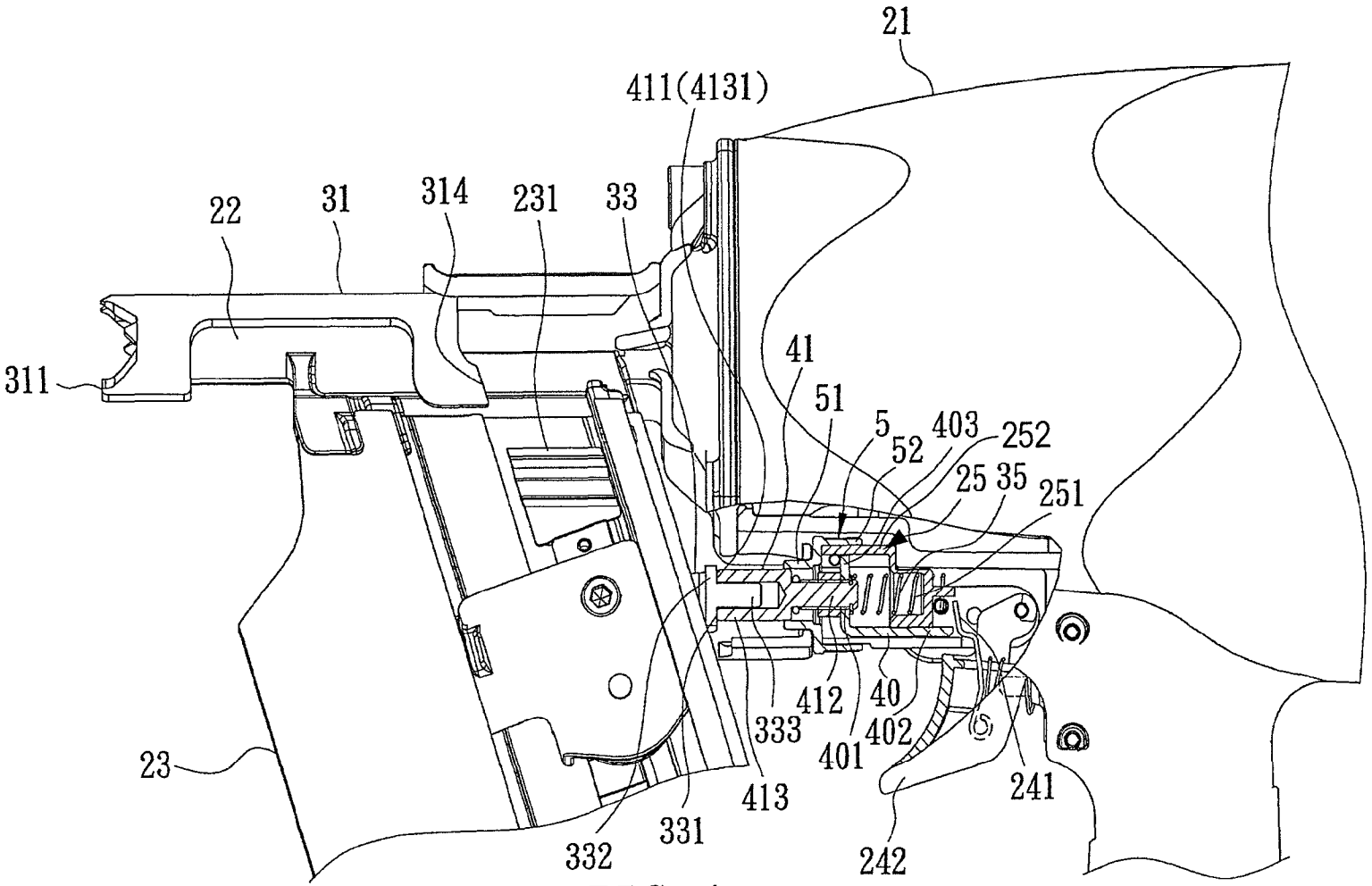
FIG. 4 is a fragmentary partly sectional view of the first preferred embodiment, illustrating a state where the distance between a driving surface of an interconnecting part and a driven surface of a second part is adjusted to zero and where an actuating member is disposed at a disabling state.
Figure 5:
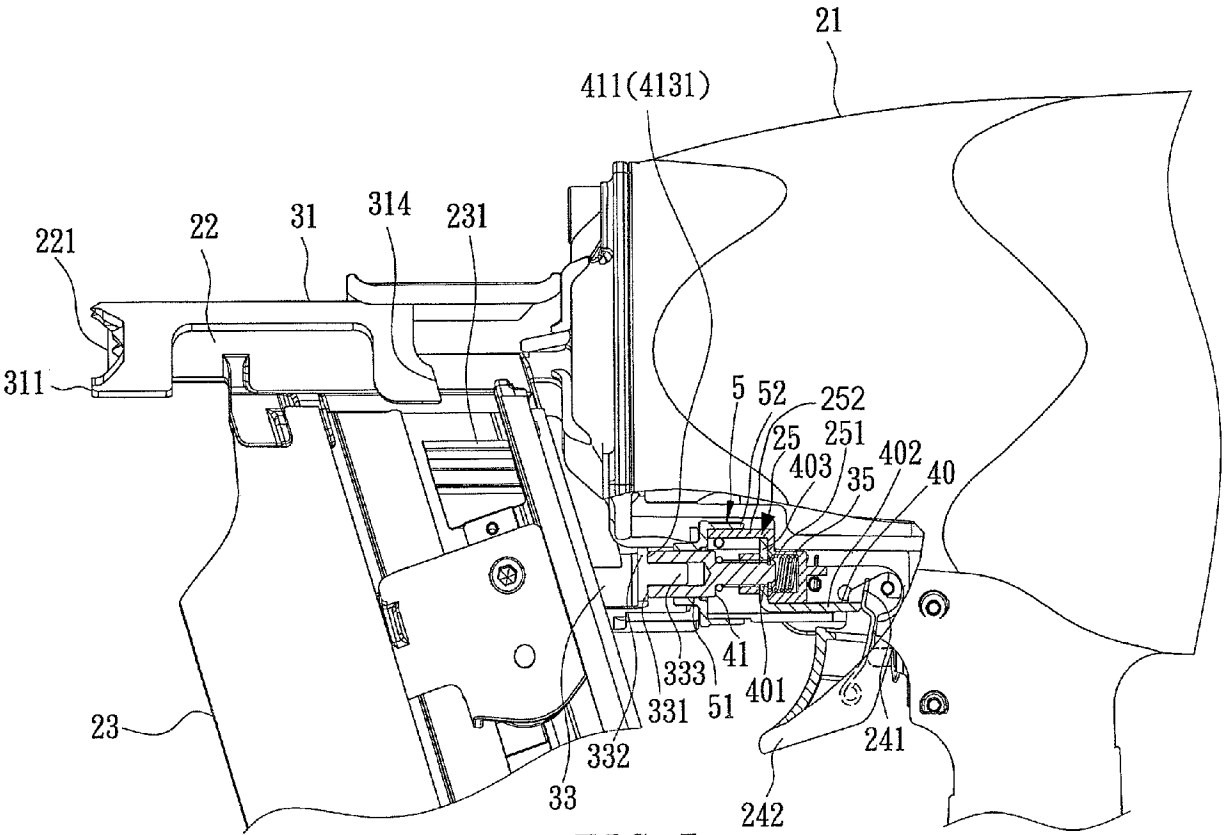
FIG. 5 is a fragmentary partly sectional view of the first preferred embodiment, illustrating a state where the distance between the driving and driven surfaces is adjusted to zero and where the actuating member is disposed at an enabling state.

FIGS. 6 and 7 illustrate the first preferred embodiment under a condition where the distance (D) between the driving and driven surfaces 331, 411 is adjusted to be greater than zero through rotation of the second part 41, while FIGS. 4 and 5 illustrate the first preferred embodiment under a condition where the distance (D) between the driving and driven surfaces 331, 411 is adjusted to be zero, i.e., the driving and driven surfaces 331, 411 contact each other, through rotation of the second part 41.

In this embodiment, the first part 40 has a thread hole 401, and the second part 41 has a threaded rod 412 that engages threadedly the thread hole 401 in the first part 40, and a hollow body 413 that extends frontwardly in the nail-discharging direction from the threaded rod 412 and that has a front open end 4131 having an end face defining the driven surface 411.

The interconnecting part 33 has an abutting flange 332 and a rear end portion 333 that extends rearwardly in the nail-discharging direction from the abutting flange 332 into the hollow body 413. The abutting flange 332 protrudes from the rear end portion 333 in a direction transverse to the nail-discharging direction, and has an end face defining the driving surface 331.

The nailing depth adjustable device further includes a driving sleeve 5 that is sleeved rotatably on the support 25 and that is sleeved on the second part 41 in such a manner to permit the second part 41 to be able to be driven by the driving sleeve 5 to rotate relative to the first part 40 and to move in the nail-discharging direction relative to the first part 40, and to permit the second part 41 together with the first part 40 to be movable relative to the driving sleeve 5 in the nail-discharging direction. The hollow body 413 of the second part 41 has a non-circular cross-section. The driving sleeve 5 has a first sleeve portion 52 that is sleeved rotatably on the support 25, and a second sleeve portion 51 that is reduced in cross-section from the first sleeve portion 52, that is sleeved on the hollow body 413, and that has a cross-section corresponding to that of the hollow body 413 so as to permit co-rotation of the driving sleeve 5 and the second part 41 and movement of the second part 41 relative to the driving sleeve 5 in the nail-discharging direction.

The support 25 defines a spring-receiving recess 251 and includes a support member (252) that is adapted to be secured to the gun housing (21)y. The first part 40 is in the form of an L-shaped plate that has a first segment 402 extending in the nail-discharging direction for driving movement of the actuating member 241, and a second segment 403 transverse to the first segment 402. The thread hole 401 is formed in the second segment 403. The telescopic adjusting unit further includes a spring 35 extending into the spring-receiving recess 251 and abutting against a periphery of the thread hole 401 in the first part 40 for urging the first and second parts 40, 41 away from the actuating member 241.

The nailing depth adjustable device further includes an urging member 6 (see FIG. 3) for restoring the barrel-extending part 31 to the starting position (see FIGS. 4 and 6) when the barrel-extending part 31 is released from the object to be nailed.

Figure 8:
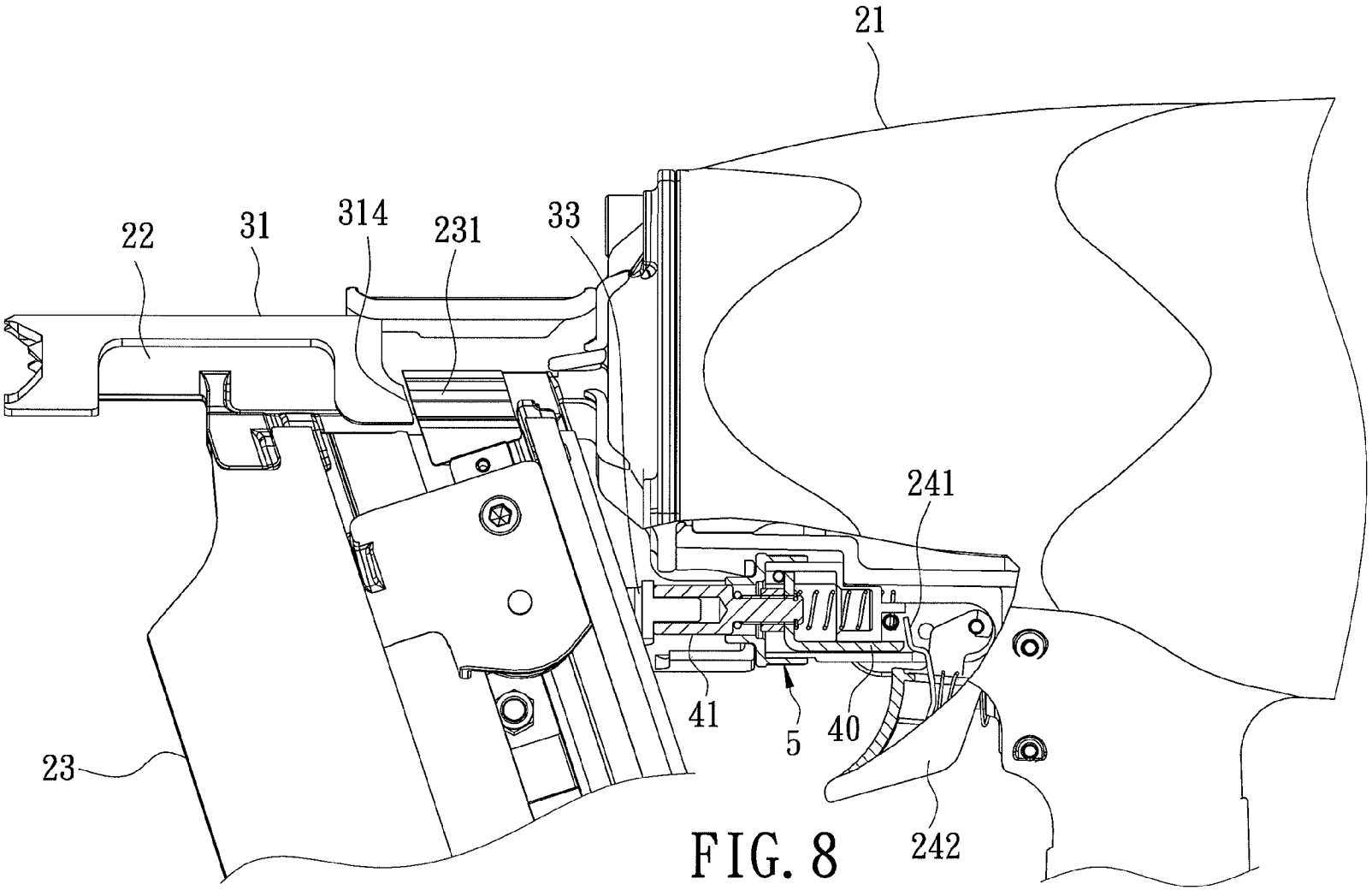
FIG. 8 is a fragmentary partly sectional view of the first preferred embodiment, illustrating a state where a magazine is emptied of the nails and where a nail-pushing member of the magazine confronts a stopper formed on a barrel-extending part.

Referring to FIG. 8, the magazine 23 includes a nail-pushing member 231 for pushing the nails into the rear end of the barrel 22. As such, when the magazine 23 is emptied of the nails, the nail-pushing member 231 will be moved to an upper end of the magazine 23. The barrel-extending part 31 is formed with a stopper 314 disposed adjacent to the upper end of the magazine 23 and confronting and aligned with the nail-pushing member 231 in the nail-discharging direction when the nail-pushing member 231 is moved to the upper end of the magazine 23 for preventing rearward movement of the barrel-extending part 31 in the nail-discharging direction when the magazine 23 is empty.

Since the position of the barrel-extending part 31 relative to the magazine 23 remains unchanged when the distance (D) between the driving and driven surfaces 331, 411 is changed, the stopper 314 can limit the barrel-extending part 31 from moving rearwardly in the nail-discharging direction through abutment with the nail-pushing member 231 when the magazine 23 runs out of the nails. On the other hand, the positions of the barrel-extending parts 15, 63 of the aforesaid conventional nail guns 1, 6 are changed when the barrel-extending parts 15, 63 are adjusted for the nailing depth, which makes it difficult for the conventional nail guns 1, 6 to have a stopper on the barrel-extending part 15, 63 to engage the nail-pushing member of the magazine.

Figure 9:
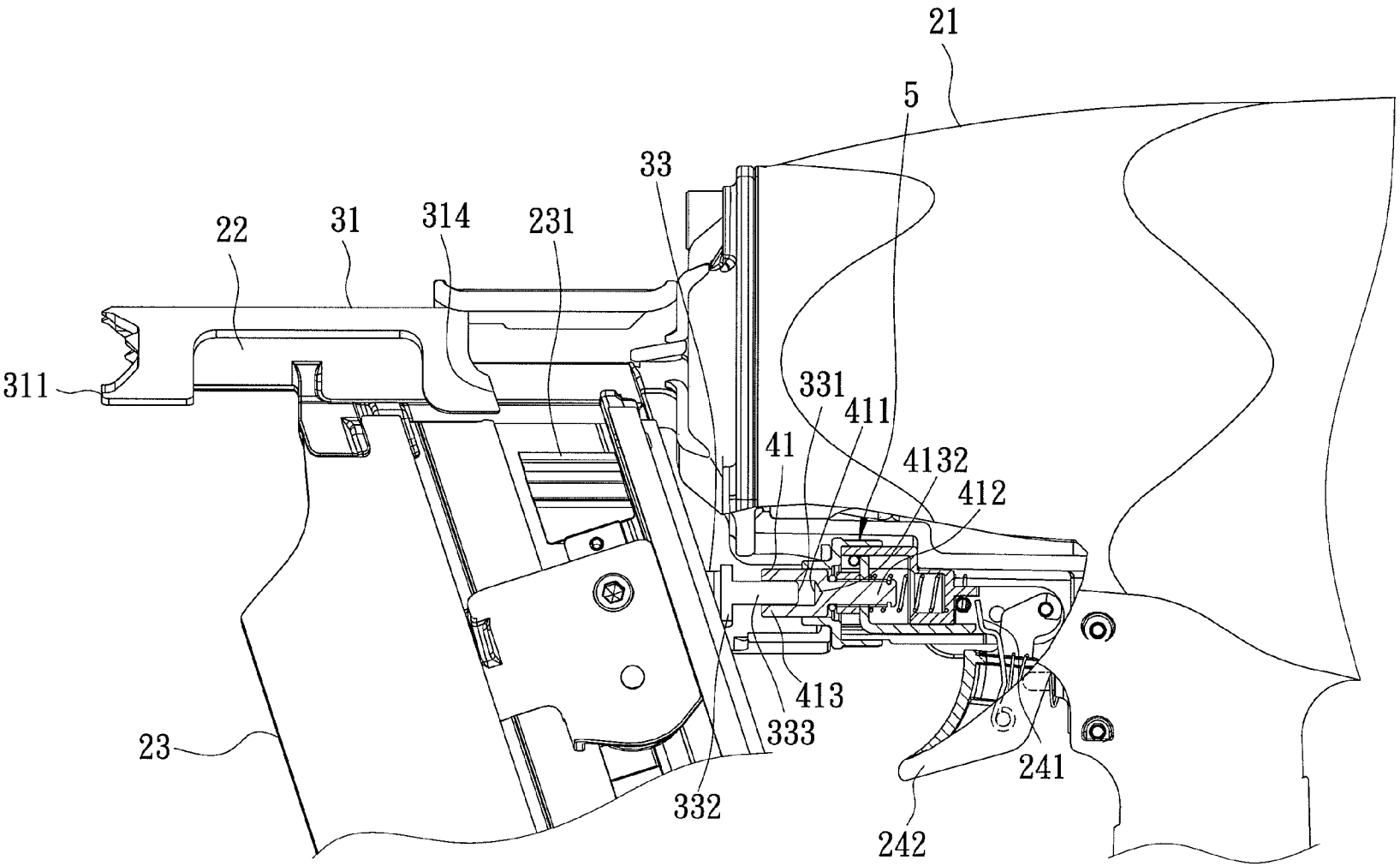
FIG. 9 is a fragmentary partly sectional view of the second preferred embodiment of a nailing depth adjustable device for a nail gun according to the present invention, illustrating a state where the distance between the driving and driven surfaces is not adjusted to zero and where the actuating member is disposed at a disabling state.
Figure 10:
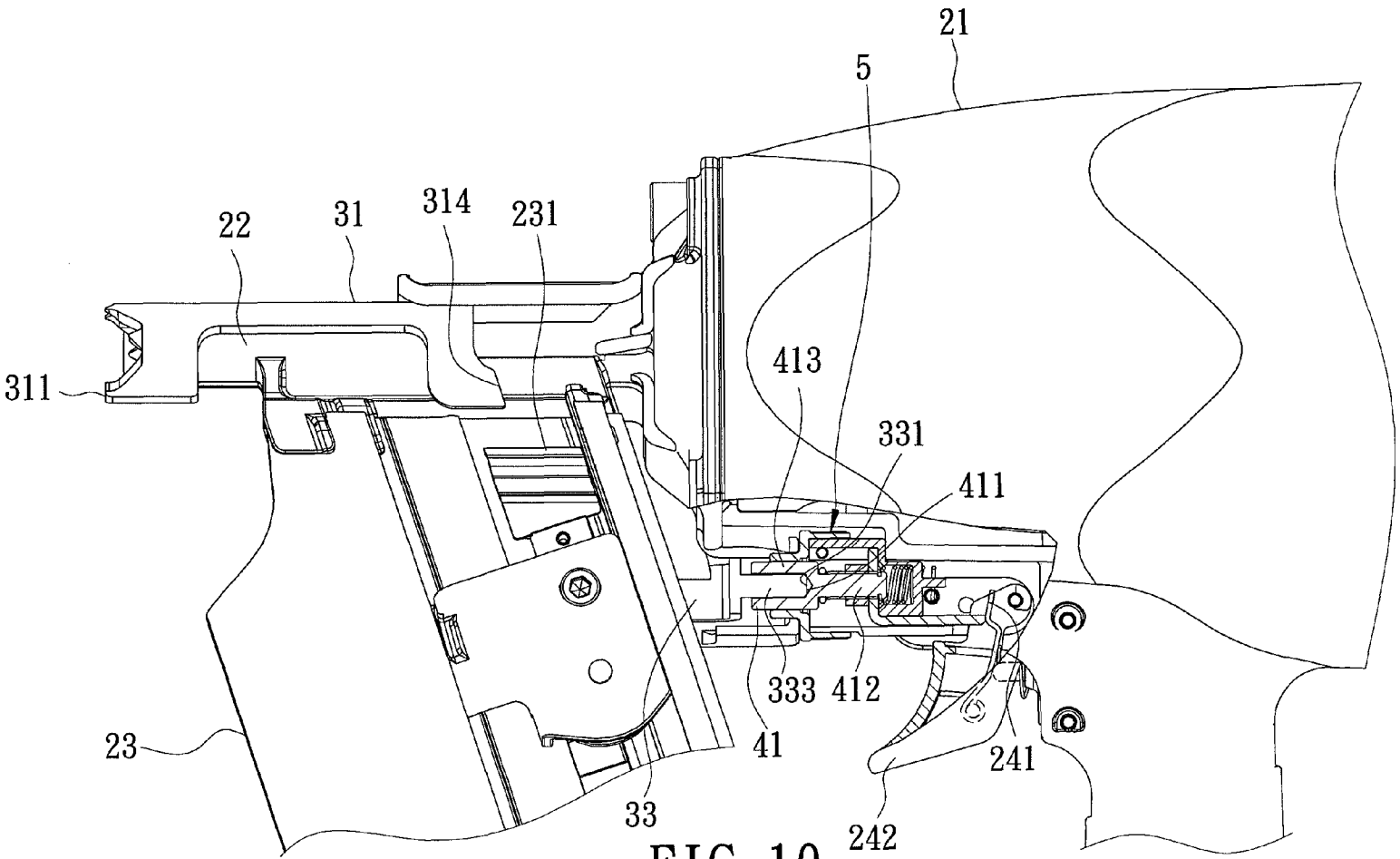
FIG. 10 is a fragmentary partly sectional view of the second preferred embodiment, illustrating a state where the distance between the driving and driven surfaces is not adjusted to zero and where the actuating member is disposed at an enabling state.

FIGS. 9 and 10 illustrate the second preferred embodiment of the nailing depth adjustable device according to the present invention. The second preferred embodiment differs from the previous embodiment in that the hollow body 413 of the second part 41 has a rear closed end 4132 having an inner end face defining the driven surface 411, and that the rear end portion 333 of the interconnecting part 33 has an end face defining the driving surface 331.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A nailing depth adjustable device for a nail gun, the nail gun including a gun housing having a front end, a barrel extending frontwardly from the front end of the gun housing in a nail-discharging direction and having a front open end, a magazine connected to a rear end of the barrel for supplying nails into the barrel, and an actuating member movable between enable and disable states for enabling and disabling discharging of the nails, said nailing depth adjustable device comprising:

a barrel-extending part adapted to be mounted slidably on the barrel so as to be slidable on the barrel in the nail-discharging direction, and having a front open end adapted to be disposed frontwardly of the front open end of the barrel for abutting against an object to be nailed and for serving as a discharging outlet of the nails;

an interconnecting part extending from said barrel-extending part so as to be co-movable with said barrel-extending part in the nail-discharging direction, and defining a driving surface;

a support unit including:

a support member that is adapted to be secured to the gun housing; and a length adjusting unit mounted movably relative to said support member and including a first part that has a first end segment extending toward said actuating member, and a second end segment disposed to be nonrotatably movable in the nail-discharging direction, and a second part that is coupled movably to said interconnecting part, that defines a driven surface facing and aligned with said driving surface in the nail-discharging direction, and that engages threadedly said first part so as to be rotatable relative to said first part and said interconnecting part and therefore to be movable relative to said first part and said interconnecting part in the nail-discharging direction, thereby permitting a distance between said driving and driven surfaces to be adjusted;

wherein said barrel-extending part and said interconnecting part are co-movable rearwardly relative to said first and second parts and said support unit in the nail-discharging direction from a starting position, where said driving and driven surfaces are spaced apart from each other to a driving position, where said driving and driven surfaces contact each other, said barrel-extending part and said interconnecting part being further co-movable rearwardly relative to said support unit in the nail-discharging direction from the driving position to a final position for a predetermined distance so as to drive said first part through said second part to co-move with said barrel-extending part and said interconnecting part to an actuating position where said first end segment of said first part actuates said actuating member to move from the disable state to the enable state, thereby permitting adjustment of a traveling distance of said barrel-extending part from the starting position to the final position through adjustment of the distance between said driving and driven surfaces, a biasing member disposed to bias said first end segment to move toward said driving position.

2. The nailing depth adjustable device as claimed in claim 1, further comprising a driving sleeve that is sleeved rotatably on said support member and that is sleeved on said second part in such a manner to permit said second part to be able to be driven by said driving sleeve to rotate relative to said first part and to move in the nail-discharging direction relative to said first part, and to permit said second part together with said first part to be movable relative to said driving sleeve in the nail-discharging direction.

3. The nailing depth adjustable device as claimed in claim 2, wherein said second end segment of said first part has a thread hole, said second part having a threaded rod that engages threadedly said thread hole in said first part, and a hollow body that extends frontwardly in the nail-discharging direction from said threaded rod and that has a front open end having an end face defining said driven surface, said interconnecting part having an abutting flange and a rear end portion that extends rearwardly in the nail-discharging direction from said abutting flange and that extends into said hollow body, said abutting flange protruding from said rear end portion in a direction transverse to the nail-discharging direction, and having an end face defining said driving surface.

4. The nailing depth adjustable device as claimed in claim 3, wherein said hollow body of said second part has a non-circular cross-section, said driving sleeve having a first sleeve portion that is sleeved on said support member, and a second sleeve portion that is reduced in cross-section from said first sleeve portion, that is sleeved on said hollow body of said second part, and that has a cross-section corresponding to that of said hollow body.

5. The nailing depth adjustable device as claimed in claim 1, wherein said second end segment of said first part has a thread hole, said second part having a threaded rod that engages threadedly said thread hole in said first part, and a hollow body that extends frontwardly in the nail-discharging direction from said threaded rod and that has a front open end having an end face defining said driven surface, said interconnecting part having an abutting flange and a rear end portion that extends rearwardly in the nail-discharging direction from said abutting flange and that extends into said hollow body, said abutting flange protruding from said rear end portion in a direction transverse to the nail-discharging direction, and having an end face defining said driving surface.

6. The nailing depth adjustable device as claimed in claim 5, wherein said support unit defines a spring-receiving recess, said first part being in the form of an L-shaped plate that has said first end segment and said second end segment transverse to said first end segment, said biasing member of said length adjusting unit having one end that extends into said spring-receiving recess and an opposite end that abuts against a periphery of said thread hole for urging said first and second parts away from the actuating member.

7. The nailing depth adjustable device as claimed in claim 1, further comprising an urging member for restoring said barrel-extending part to the starting position when said barrel-extending part is released from the object to be nailed.

8. The nailing depth adjustable device as claimed in claim 1, wherein said second end segment of said first part has a thread hole, said second part having a threaded rod that engages threadedly said thread hole in said first part, and a hollow body that extends frontwardly in the nail-discharging direction from said threaded rod and that has a rear closed end having an inner end face defining said driven surface, said interconnecting part having a rear end portion that extends into said hollow body and that has an end face defining said driving surface.

* * * * *